United States Patent [19]

Benson

[11] Patent Number: 4,986,544

[45] Date of Patent: Jan. 22, 1991

[54] GOLF PUTTER

[76] Inventor: Glenn S. Benson, 19509 Pasadena, South Bend, Ind. 46614

[21] Appl. No.: 521,905

[22] Filed: May 11, 1990

[51] Int. Cl.[5] ..... A63B 53/04; A63B 69/06

[52] U.S. Cl. ..... 273/183 D; 273/164; 273/194 A

[58] Field of Search ..... 273/183 R, 183 D, 164, 273/194 A, 186 A, 186 C; 434/252

[56] References Cited

U.S. PATENT DOCUMENTS

| | | | |
|---|---|---|---|
| 2,503,506 | 4/1950 | Miller | 273/194 A X |
| 3,880,430 | 4/1975 | McCabe | 273/183 D |
| 4,136,877 | 1/1979 | Antonious | 273/164 |
| 4,140,318 | 2/1979 | Izett et al. | 273/167 A |
| 4,141,556 | 2/1979 | Paulin | 273/164 |
| 4,306,721 | 12/1981 | Doyle | 273/163 R |
| 4,343,472 | 8/1982 | Hamilton | 273/164 |
| 4,367,877 | 1/1983 | Gibson et al. | 273/183 D X |
| 4,390,184 | 6/1983 | Rudell | 273/183 D |
| 4,508,350 | 4/1985 | Duclos | 273/183 D |
| 4,519,612 | 5/1985 | Tsao | 273/163 R |
| 4,527,799 | 7/1985 | Solheim | 273/164 |

*Primary Examiner*—William H. Grieb
*Attorney, Agent, or Firm*—Thomas J. Dodd

[57] ABSTRACT

A golf putter which includes a clubhead having a visual indicator block affixed thereto. The block is used in conjunction with a material strip of a contrasting color to provide visual indication of a proper (or improper) eye and clubhead portion prior to the stroke.

4 Claims, 2 Drawing Sheets

GOLF PUTTER

FIELD OF THE INVENTION

This invention relates to golf putters and will have special application to a putter which includes a visual indicator to inform the golfer that the club is properly soled and that the golfer's head is properly oriented over the ball.

BACKGROUND OF THE INVENTION

While each golfer tends to possess his own unique style of putting, two basic fundamentals are, with few exceptions, practiced by those who have mastered this aspect of the game. The first fundamental is the proper position of the eyes during the stroke, that is, centered directly over the ball. The second fundamental is the proper positioning of the putter with the sole resting flat on, or slightly above, the putting surface.

Prior putters have, for the most part, failed to assist the golfer in practicing these basic fundamentals, instead concentrating on putter alignment, and heel and toe weighting to counter off-center hits. Several of these putters are embodied in the patents shown in the accompanying information disclosure sheet. One of these putters (U.S. Pat. No. 3,880,430) does purport to assist the golfer in head positioning by utilizing three sightlines located on the putter flange.

SUMMARY OF THE INVENTION

The putter of this invention provides for visual confirmation of the proper positioning of the golfer's head and also that the club has been properly soled at address. The putter includes a solid block which extends rearwardly of the ball-striking face. The block is positioned in generally the center of a sighting strip located on the putter flange. The block and strip are of contrasting colors which provides an instant visual indication of the golfer's head positioning and the soling angle of the putter. As a result, the golfer will strike more putts along his intended line and produce a more consistent roll of &he ball.

Accordingly, it is an object of this invention to provide for an improved golf putter.

Another object is to provide a putter which visually communicates to a golfer the proper eye and sole positioning prior to the stroke.

Another object is to provide a putter which, used properly will produce a more consistent roll of the ball along the intended target line.

Other objects will become apparent upon a reading of the following description.

BRIEF DESCRIPTION OF THE DRAWINGS

A preferred embodiment of the invention has been depicted for illustrative purposes only wherein.

DESCRIPTION OF THE PREFERRED EMBODIMENT

The preferred embodiment herein described is not intended to be exhaustive or to limit the invention to the precise form disclosed. It is chosen and described to explain the principles of the invention and its application and practical use to enable others skilled in the art to utilize its teachings.

Figure 1:
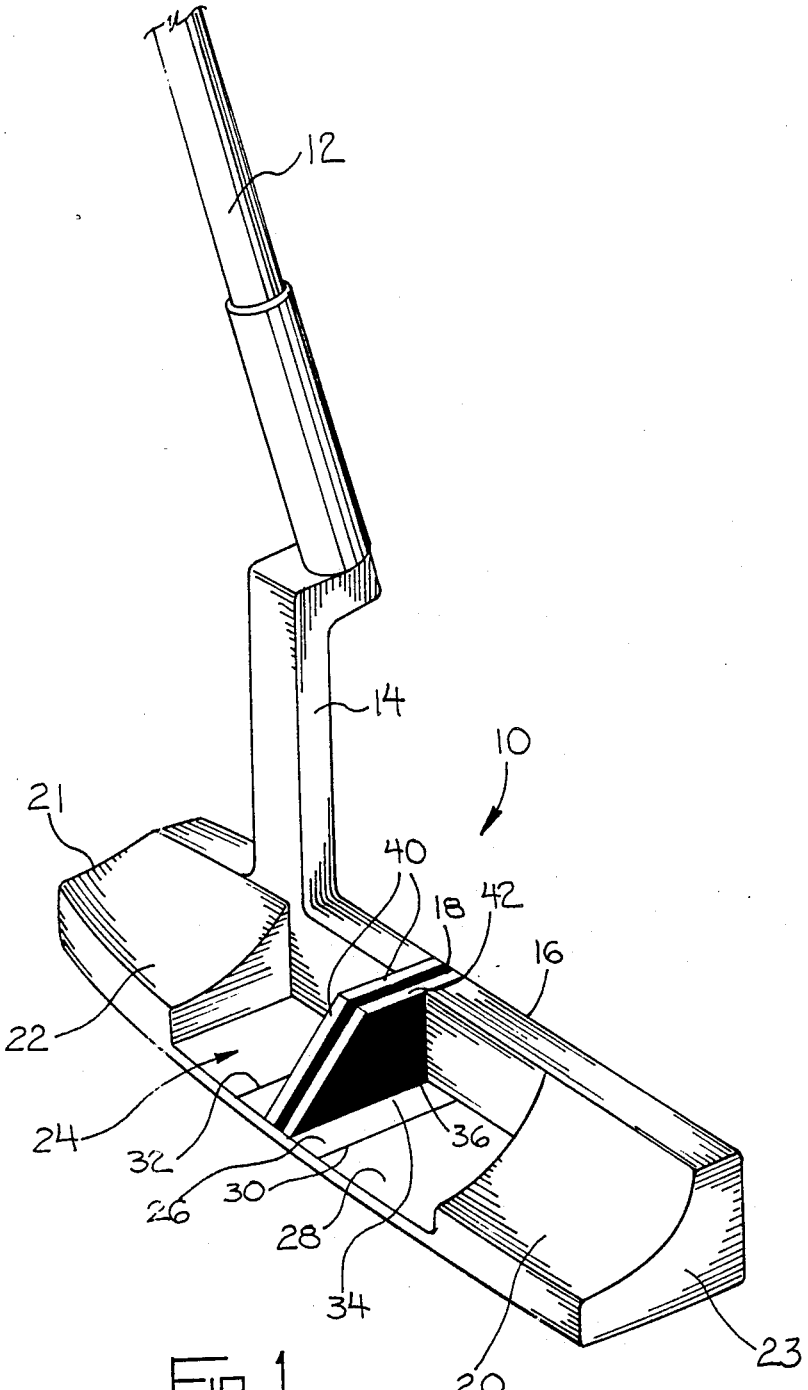
FIG. 1 is a fragmented perspective view of the putter of this invention.

Referring now to the FIG. 1, reference numeral 10 generally depicts a golf putter head constructed according to the principles of this invention. Putter head 10 is connected to an elongated shaft 12 which terminates in a grip (not shown) and is used to roll a golf ball (not shown) along the ground, usually after a golfer has landed his ball on a putting green. The putter head 10 shown has an offset hosel 14 but the principles of this invention will apply to nearly any currently existing putter head shape.

Putter head 10 defines a ball striking portion 16, whose center of gravity (commonly referred to in the trade as the sweetspot) is located along dark colored line 18. Putter head 10 illustrated is a heel-and-toe weighted model with weighted portions 20, 22 positioned adjacent the terminal ends of the head to define a centrally located cavity 24. This positioning of weight counteracts the tendency of the head 10 to twist or torque when a ball is struck slightly off center and is a common feature on a number of different putters.

A strip 26 of tape or similar material (paint may also be used) is located on bottom flange 28 of head 10 between weighted portion 20, 22. Preferably, strip 26 is located with its terminal edges 80, 32 equidistant from the sweetspot designated by dark line 18. A block 34 of any suitable material and shape is affixed to putter head 10 and preferably located in the geometric center of strip 26 as shown. Block 34 has side walls 36, 38 and one or more end walls 40 (two are shown).

End walls 40 of block 34 preferably include dark colored line 18 to assist the golfer with target line selections and to identify the sweetspot. As shown, line 18 is bordered by sections of light colored lines 42 which sharply contrast with line 18. Each side wall 36, 38 is of dark colors similar to the color of line 18. Strip 26 is preferably of a light color sharply contrasting to line 18 and side walls 36, 38.

Figure 2:
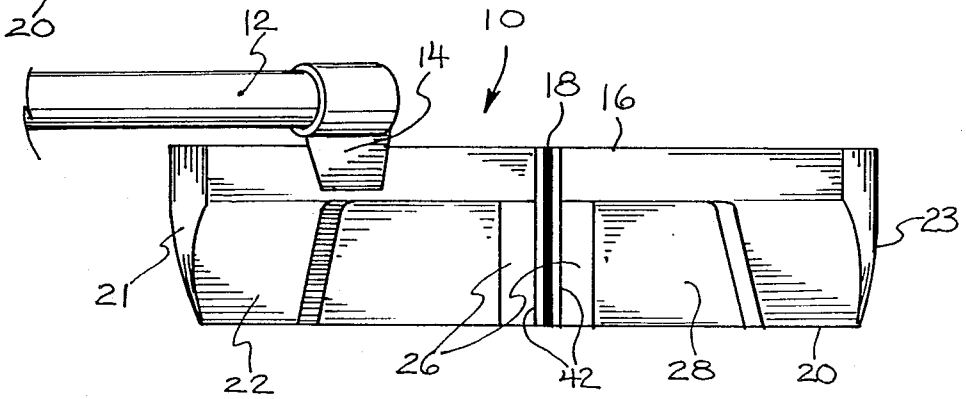
FIG. 2 is a fragmented top view of the putter which illustrates the visual alignment aid in the proper position.
Figure 3:
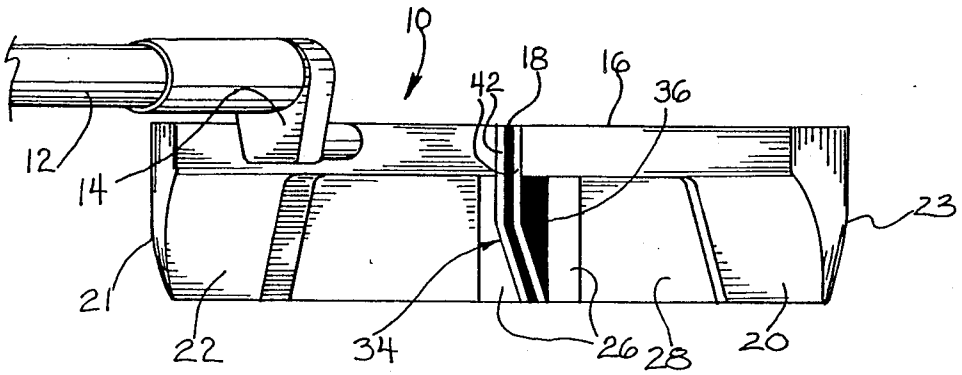
FIG. 3 is a fragmented top view of the putter which illustrates the visual image seen when the golfer's eyes are outside the intended target line or the putter is positioned with the toe pointing skyward.
Figure 4:
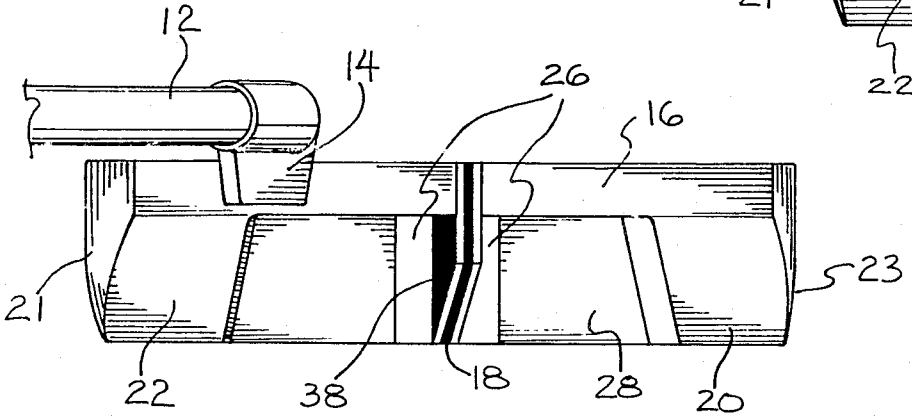
FIG. 4 is a fragmented top view of the putter with the golfer's eyes inside the intended target line, or with the heel pointing skyward.

Operation of putter head 10 as a visual indicator is shown in FIGS. 2–4. In FIG. 2, the golfer (not shown) has achieved proper positioning of eyes and club and sees only lines 18 and 42 and strip 26 which is preferably the same color as lines 42 so as to blend in therewith. FIG. 3 illustrates the view a golfer will see when the toe 23 of head 10 is pointed skyward if he sets his eyes outside of the intended target line. In this position, t he golfer will see the contrasting color of side wall 36 and strip 26 and will know to realign his head or the putter head 10. In FIG. 4, the golfer has positioned his eyes inside the target line or has pointed the heel 21 of head 10 skyward. The sight of wall contrasting with strip 26 will serve to tell the golfer to again reposition to achieve the correct alignment position (FIG. 2).

It is understood that the invention is not limited to the details above given, but may be modified within the scope of the following claims.

I claim:

1. In a golf putter including a shaft, and a clubhead having a ball-striking face attached to an end of said shaft, said club head defining a flange extending rearwardly of said ball-striking face, the improvement wherein said flange includes a horizontal s&rip of a first color oriented along an intended target line and positioned adjacent a sweetspot of said ball-striking face, and a vertically oriented block of a narrower width than the width of said strip, said block having sides of a second color contrasting said first color and positioned substantially along the center of said strip to provide a visual indicator of proper eye and putter positioning when viewed from above the putter.

2. The golf putter of claim 1 wherein said block further defines an outer edge, said outer edge including a stripe of said second color extending down a center of said outer edge, and stripes of said first color extending down peripheral edges of said outer edge.

3. The golf putter of claim 2 wherein said block is substantially trapezoidally shaped.

4. The golf putter of claim I wherein said first color is white and said second color is black.

* * * * *